US006047898A

United States Patent [19]

Cox

[11] Patent Number: 6,047,898

[45] Date of Patent: Apr. 11, 2000

[54] PORTABLE FOUNTAIN

[75] Inventor: Lem L. Cox, New Braunfels, Tex.

[73] Assignee: Alert Services, Inc., San Marcos, Tex.

[21] Appl. No.: 09/322,370

[22] Filed: May 28, 1999

Related U.S. Application Data

[60] Provisional application No. 60/087,173, May 29, 1998.

[51] Int. Cl.[7] ..... B05B 3/00

[52] U.S. Cl. ..... 239/24; 239/146; 239/332; 239/289; 239/29.3; 239/24

[58] Field of Search ..... 239/722, 146, 239/273, 332, 723, 351, 548, 379, 29.3, 24, 289

[56] References Cited

U.S. PATENT DOCUMENTS

| | | | |
|---|---|---|---|
| 2,575,936 | 11/1951 | Andrews | 239/29.3 |
| 2,621,073 | 12/1952 | Behrens | 239/24 |
| 3,142,443 | 7/1964 | Morgan | 239/24 |
| 3,232,482 | 2/1966 | Stock et al. | 239/722 |
| 5,622,319 | 4/1997 | Babb et al. | 239/722 |
| 5,752,661 | 5/1998 | Lewis | 239/332 |
| 5,961,048 | 10/1999 | Prieschl et al. | 239/146 |
| 5,979,793 | 11/1999 | Louis | 239/146 |

*Primary Examiner*—Kevin Weldon
*Assistant Examiner*—Dinh Q. Nguyen
*Attorney, Agent, or Firm*—Jackson Walker L.L.P.

[57] ABSTRACT

A portable fountain having a hand truck supporting a liquid reservoir. A control cabinet is attached to the upper portion of the truck. The control cabinet encloses a suction pump and the electronics to withdraw liquid from the reservoir. A multiplicity of hoses having control spouts are attached to a dispensing manifold in fluid communication with the suction pump.

3 Claims, 2 Drawing Sheets

PORTABLE FOUNTAIN

This application claims priority to U.S. Provisional Patent Application Ser. No. 60/087,173, filed May 29, 1998.

BACKGROUND OF THE INVENTION

The present invention relates to a liquid dispensing apparatus and more particularly to a wheel-mounted liquid fountain having an automatic pump connected to a dispensing manifold and a multiplicity of dispensing spouts.

It is well known in the art to provide a liquid container on a carrier to transport water or other liquids to remote locations. Numerous types of pumps have been attached to the carrier to achieve a powered dispensing operation. However, with hand trucks serving as the carrier, most existing systems do not provide for a pumping operation or more than a single dispensing source.

Therefore, there is a need for an all-purpose, portable liquid dispensing unit operable in remote locations without auxiliary power. Further, there is a need for a portable unit having a multiplicity of dispensing spouts so that more than one user is provided with dispensed liquids.

SUMMARY OF THE INVENTION

The present invention provides a readily portable liquid dispenser with a self-contained, rechargeable battery-operated, self-priming pumping system. A dispensing manifold directs liquid to a multiplicity of dispensing hoses and spouts. The portable dispenser unit may be hauled over uneven terrain surfaces because of the balanced frame which retains the liquid container in a lower section, centered about two large wheels. The manifold is disposed within a control cabinet attached to the upper section of the frame near the truck handle. The dispenser operates in nearly all weather conditions, except extreme sub-freezing temperatures.

DETAILED DESCRIPTION OF THE PREFERRED EMBODIMENT

Figure 1:
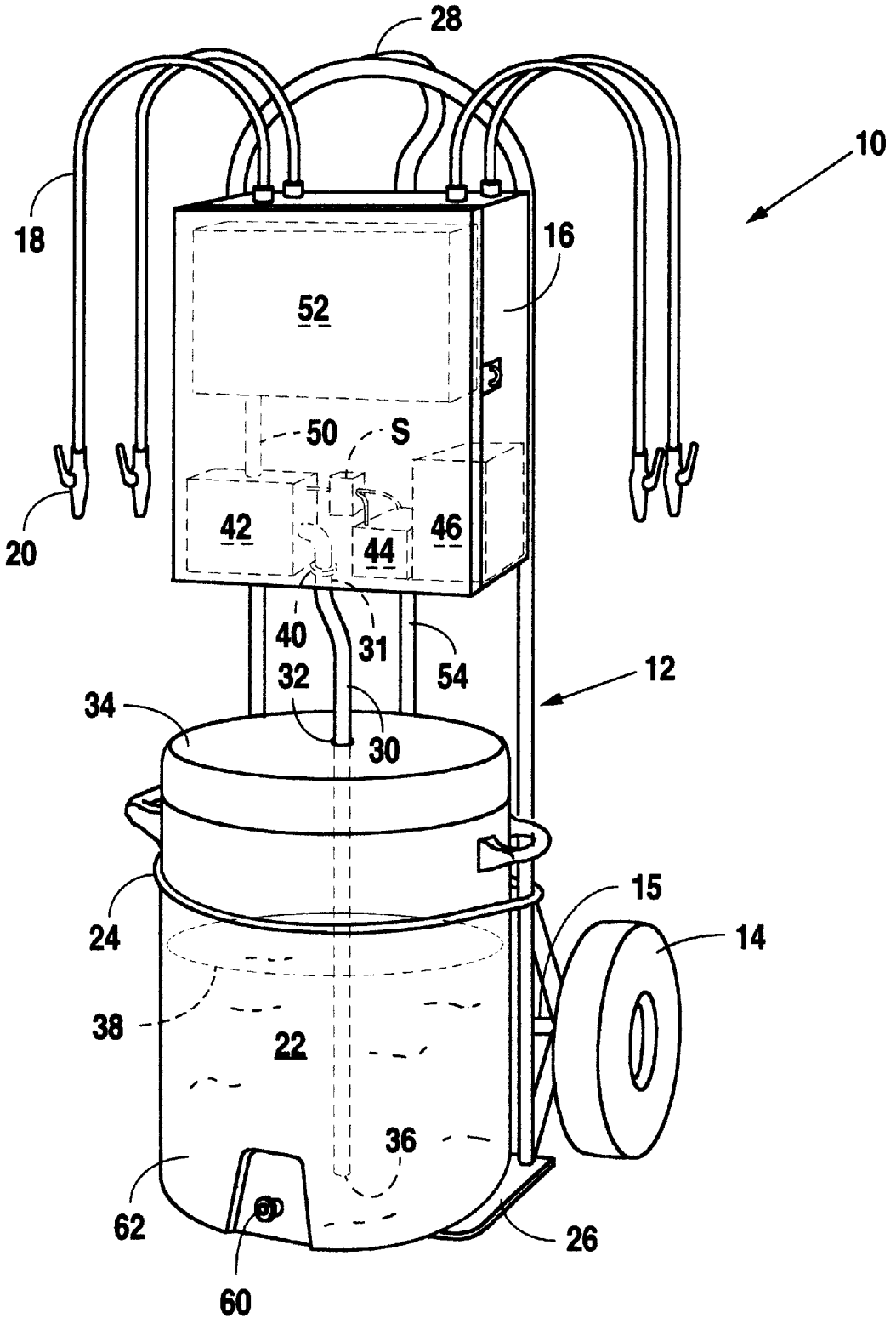
FIG. 1 illustrates a perspective view of the present invention with the manifold, pump, switch, battery and recharger in broken lines within the control cabinet.

FIG. 1 shows the present portable fountain 10 with hand-truck frame 12, wheels 14, control cabinet 16, hoses 18, spouts 20, cooler 22, mounting strap 24, base platform 26, and handle 28. As may be seen from FIG. 1, a suction line 30 extends through a central opening 32 in the removable cover or lid 34 of ten-gallon cooler 22 and through opening 31 in cabinet 16. The inlet 36 of the suction line 30 is beneath the liquid level 38 within the cooler 22. The discharge end 40 is attached to the feed pump 42 inlet within the cabinet 16.

The pump 42 is activated by an automatic on/off toggle switch S in the circuit between the battery 44 and the pump 42. Pump 42 is a self-priming pump which maintains a constant discharge pressure. When liquid is dispensed from the spouts, the pressure at the discharge of the pump drops and the pump automatically turns on to maintain the set discharge pressure and pump liquid from the cooler. When the battery 44 is in need of charging, charger 46 may be appropriately electrically connected to a standard 120 v. a.c. power line to recharge the battery 44. When the battery cannot be recharged, the present fountain 10 is still operational by use of the standard gravity feed dispensing spout 60 in the base 62 of the cooler 22.

Figure 2:
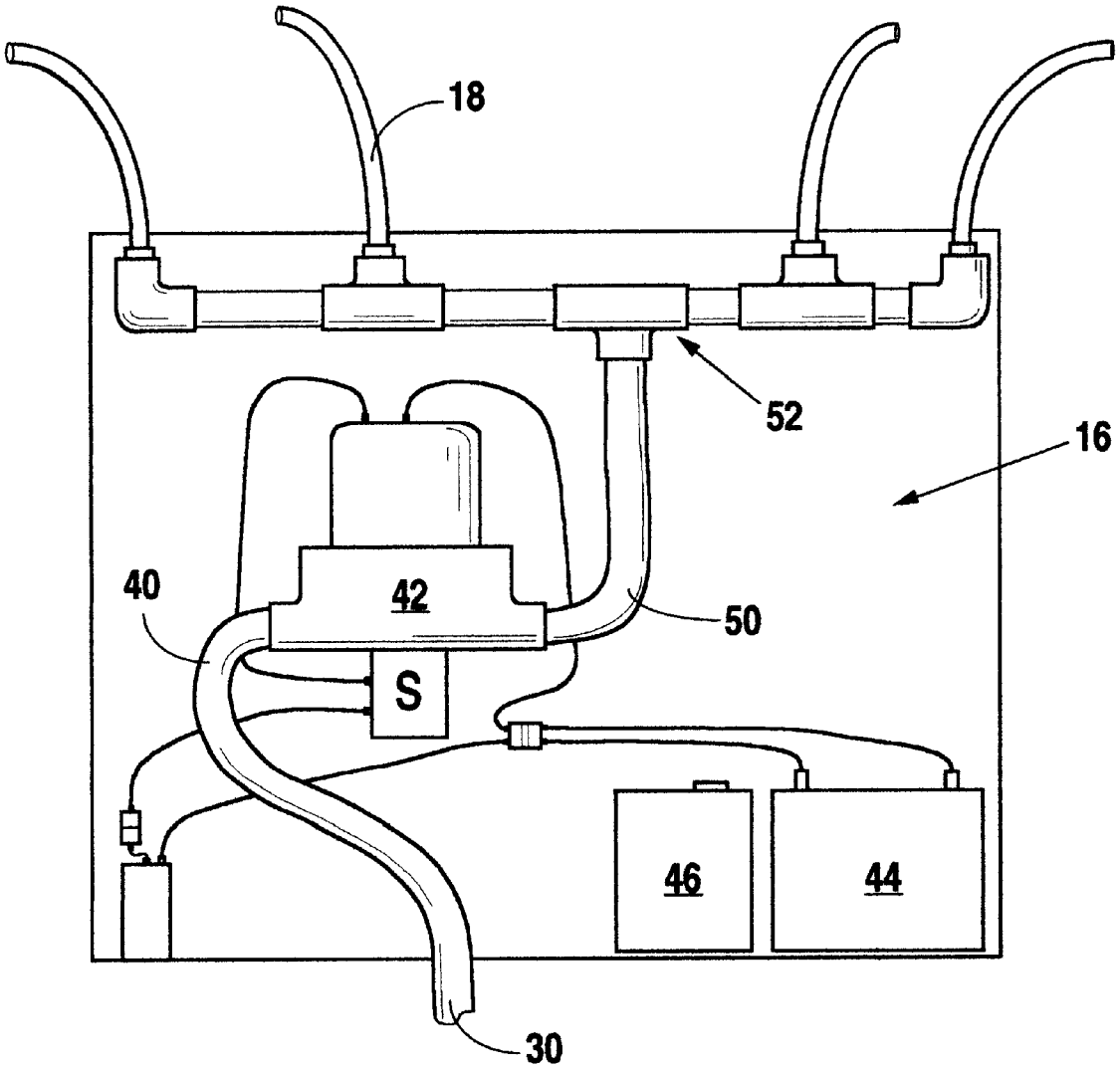
FIG. 2 shows a perspective view of the inside of the control cabinet of the present invention.

A discharge conduit 50 connects the pump 42 to the liquid manifold 52 which in turn is connected to a multiplicity of braided nylon dispensing hoses 18 and brass service spouts 20. FIG. 1 shows four hoses and spouts. FIG. 2 shows the arrangement of elements within the control cabinet.

Hand-truck frame 12 has an upper handle 28 and two lower 10" wheels 14. The opposed wheels are joined by common axle 15. A center reinforcing post 54 is provided and extends from the handle 28 to the base platform 26. Platform 26 is wide enough to support cooler 22 in cooperation with strap 24. In use the truck 12 may be tilted backward on to wheels 14 lifting the cooler 22. The truck may then easily be moved by pulling the truck 12 by handle 28.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

What is claimed is:

1. A portable fountain comprising:

a hand truck having two opposed wheels joined by a common axle, a frame, a handle, and a base platform;

a control cabinet attached to an upper portion of said truck, said cabinet enclosing a suction pump in fluid communication at a discharge end with a dispensing manifold and electrically connected to a d.c. battery power source through an on/off switch, said manifold in fluid communication with a multiplicity of hoses having control spouts;

a liquid reservoir releasably attachable to a lower section of said truck, said reservoir having a removable lid with a central opening and a gravity feed discharge spout;

a suction fine extending through said central opening in said lid and into fluid communication with the interior of said reservoir, an opposite end of said suction line extending through an opening in said cabinet and connected in fluid communication with an inlet of said pump.

2. The fountain of claim 1 wherein said pump is a self-priming, pressure-sensitive pump.

3. The fountain of claim 1 further comprising a battery recharge unit electrically connected to said battery power source and disposed within said control cabinet.

* * * * *